US005113971A

United States Patent [19]

Violet

[11] Patent Number: 5,113,971

[45] Date of Patent: May 19, 1992

[54] ADJUSTABLE ROOFING JACK

[76] Inventor: Roy L. Violet, Rte. 1, Box B-477, Lake City, Tenn. 37769

[21] Appl. No.: 666,784

[22] Filed: Mar. 8, 1991

[51] Int. Cl.[5] ..... E04G 3/12

[52] U.S. Cl. ..... 182/45; 248/237

[58] Field of Search ..... 182/45; 248/237

[56] References Cited

U.S. PATENT DOCUMENTS

| | | | |
|---|---|---|---|
| 214,330 | 4/1879 | Walker | 248/237 |
| 285,164 | 9/1883 | Ryan . | |
| 687,666 | 11/1901 | Spring . | |
| 1,111,707 | 9/1914 | Schorn . | |
| 1,159,216 | 11/1915 | Hans . | |
| 1,172,227 | 2/1916 | Schade . | |
| 1,241,335 | 9/1917 | Boyd . | |
| 1,255,692 | 2/1918 | Bearden . | |
| 1,562,965 | 11/1925 | Hubschmitt, Jr. . | |
| 1,592,384 | 7/1926 | Peck . | |
| 1,639,352 | 8/1927 | Schade . | |
| 1,691,478 | 11/1928 | Henderson . | |
| 1,827,491 | 10/1931 | Spillman . | |
| 1,886,921 | 11/1932 | Tobin . | |
| 2,496,556 | 2/1950 | Nelson . | |
| 4,856,745 | 8/1989 | Mabie . | |
| 4,884,775 | 12/1989 | Fischer, Jr. . | |
| 4,946,123 | 8/1990 | Albert . | |

*Primary Examiner*—Reinaldo P. Machado
*Attorney, Agent, or Firm*—Pitts & Brittian

[57] ABSTRACT

An adjustable roofing jack (10) for securing a scaffold (22) of a selected size for roofers to prevent falls and other dangers associated with working on an inclined surface, and especially high-pitched roofs. The adjustable roofing jack (10) includes a frame (12) for engaging the surface of the roof (24). The frame (12) includes an extended portion (34) for engaging one side of a scaffold board (22). An opening (36) is defined by the extended portion (34) for the receipt of a nail, screw or other conventional fastener (38) to prevent the scaffold board (22) from rotating axially. Slotted openings (42) are defined by the frame (12) for receiving at least one selected fastener (40) to secure the adjustable roofing jack (10) to the roof (24). A scaffold support (16) is attached to the frame (12) for supporting a scaffold board (22) of a selected width. An adjuster (18) is provided for altering the effective width of the scaffold support (16). The adjuster (18) includes an angled member (56) and a fastener (64) for securing the angled member (56) to the scaffold support (16). An opening (70) is defined by the frame (12) for storing the adjuster (18) when not deployed.

20 Claims, 3 Drawing Sheets

ADJUSTABLE ROOFING JACK

This application in part discloses and claims subject matter disclosed in my earlier filed pending application, Ser. No. 07/555,753 filed on Sep. 24, 1990.

TECHNICAL FIELD

This invention relates to the field of roofing. Specifically, this invention relates to an adjustable roof jack for securing a scaffold of a selected size for roofers to prevent falls and other dangers associated with working on an inclined surface, and especially high-pitched roofs.

BACKGROUND ART

In the field of roofing it is an essential to provide some means of support for roofers to prevent slipping or falling from an inclined roof. Typically, this includes a length of board laid across at least a pair of supports. This board, or scaffold, is used to support a portion of the weight of a roofer, and depending upon the orientation of the board with respect to the horizontal, may be used to support tools or other items employed by roofers. It is known that roofers typically use the present type of scaffolding by sitting on the roof surface and resting the downside foot on the top surface of the board. Thus, it can be seen that, for the roofer's maximum protection from slipping, the board should be inclined to be approximately normal to the roof surface. It is also known that roofers cannot always carry an assortment of boards, and therefore do not always have available the correct size board for the scaffold supports used, thus, the roofers are inclined to place a board of the wrong width on the supports. This practice can be readily seen to be dangerous as an improper board width makes impossible the proper fixing of the board with respect to the support. Thus, for the maximum protection of the roofer, the scaffold support should provide a means for inclining the boards and for adjusting to varying widths of boards.

In the first Office Action to the original application, the Examiner cited a number of references material to the prosecution of the application. These references include U.S. Pat. Nos. 285,164 issued to P. W. Ryan on Sep. 18, 1883; 1,172,227 issued to E.A. Schade on Feb. 15, 1916; 1,241,335 issued to J. R. Boyd on Sep. 25, 1917; 1,255,692 issued to D. B. Bearden on Feb. 5, 1918; 1,562,965 issued to H. A. Hubschmitt, Jr. on Nov. 24, 1925; 1,639,352 issued to E. A. Schade on Aug. 16, 1927; 1,886,921 issued to R. J. Tobin on Nov. 8, 1932; and 4,946,123 issued to R. P. Albert on Aug. 7, 1990.

In addition to these, other devices have been constructed to serve these purposes. Typical of the art are those devices disclosed in U.S. Pat. Nos. 687,666 issued to F. L. Spring on Nov. 26, 1901; 1,111,707 issued to O. Schorn on Sep. 22, 1914; 1,159,216 issued to G. H. Hans on Nov. 2, 1915; 1,592,384 issued to A. G. Peck on Jul. 13, 1926; 1,691,478 issued to A. P. Henderson on Nov. 13, 1928; 1,827,491 issued to E. T. Spillman on Oct. 13, 1931; 2,496,556 issued to A. J. Nelson on Feb. 7, 1950; 4,856,745 issued to D. Mabie on Aug. 15, 1989; and 4,884,775 issued to K. W. Fischer, Jr. on Dec. 5, 1989.

Of these devices, none provides for the inclination of the board to a position approximately normal to the roof while also providing an adjustment means for adjusting to the various widths of boards which may be employed.

Therefore, it is an object of this invention to provide a means for supporting a scaffold used to support roofers when working on an inclined roof.

It is also an object of this invention to provide a roofing jack whereby the scaffold is oriented in a plane substantially normal to the roof surface.

Another object of this invention is to provide a roof jack which may be adjusted to secure various widths of scaffold boards.

Still another object of this invention is to provide a means for securing the adjustment means when not in use such that the adjustment means is not misplaced when removed.

Yet another object of this invention is to provide a means such that the roof jack may be easily attached and removed from the roof surface.

DISCLOSURE OF THE INVENTION

Other objects and advantages will be accomplished by the present invention which serves to secure a scaffold of a selected size for roofers to prevent falls and other dangers associated with working on an inclined surface, and especially high-pitched roofs. The adjustable roofing jack of the present invention includes a frame for engaging the surface of the roof. The frame includes a portion with a substantial V-shape configuration. The preferred embodiment is fabricated from a steel plate of a selected width and thickness, the steel plate being bent to form the V-shaped portion. One embodiment of the frame, as shown in the figures, includes a portion extending from the second end. As shown, this extended portion is provided to engage one side of a scaffold board when the adjustment means is not deployed, and thus defines the board width limit without necessitating the alteration of the board. An opening is defined by the extended portion for the receipt of a nail, screw or other conventional fastener, the fastener attaching to a scaffold board and being used to prevent the scaffold board from rotating axially.

A securement means is carried by the frame for receiving at least one selected fastener to secure the adjustable roofing jack to the roof. In the preferred embodiment, at least two angled slots are defined by the frame proximate the first end, depending from one side and extending toward the frame first end. The slots allow for the removal of the roofing jack while leaving the fasteners in place for subsequent use at the same position.

A scaffold support means is attached to the frame proximate the first and second ends of the V-shaped portion for supporting a scaffold board of a selected width. The preferred embodiment is fabricated from a steel plate of a selected width and thickness equal to that of the frame. The scaffold support means is connected to the frame V-portion such as to define a substantial right triangle.

An adjustment means is provided for altering the effective width of the scaffold support means. The adjustment means includes an angled member and a fastening means for securing the angled member to the scaffold support means, the fastening means of the preferred embodiment including at least one opening defined by the angled member, at least one cooperating opening defined by the scaffold support means, and a conventional fastener such as a bolt and cooperating lock washer and wing nut. The cooperating openings defined by each of the angled member and the scaffold support means are dimensioned such as to receive the fastener and fix the position of the angled member in relation to the scaffold support member in at least two positions. The upwardly extending leg of the angled member defines an opening dimensioned to receive a fastener such as a nail or screw to receive a nail, screw or other conventional fastener, the fastener attaching to a scaffold board and being used to prevent the scaffold board from rotating axially. A storage means for storing the adjustment means when not deployed is carried by the frame, the storage means including an opening defined by the V-portion of the frame. The opening is dimensioned to cooperate with the angled member opening to receive the adjustment means fastener.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
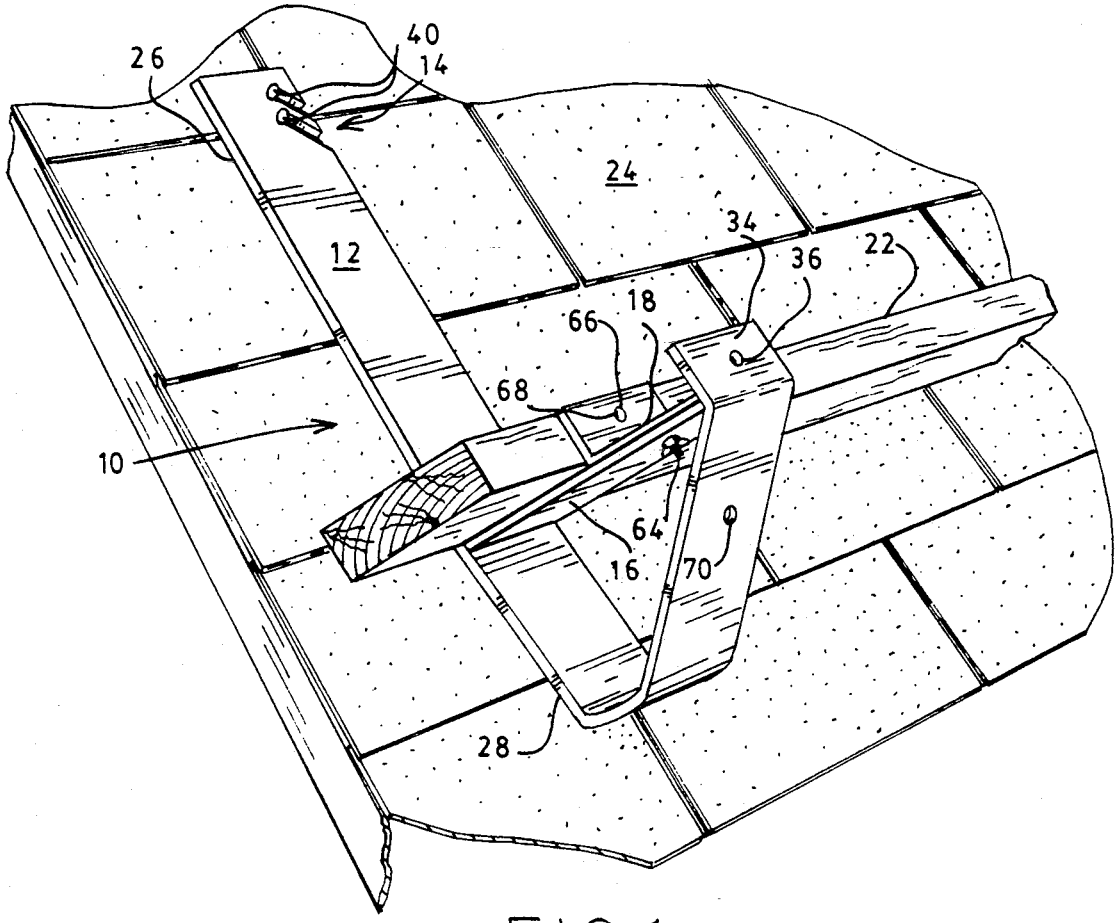
FIG. 1 is a perspective view of the adjustable roofing jack constructed in accordance with several features of the present invention showing the adjustment means employed.

An adjustable roofing jack incorporating various features of the present invention is illustrated generally at 10 in the figures. The adjustable roofing jack 10 is designed for securing a scaffold 22 of a selected size for roofers to prevent falls and other dangers associated with working on an inclined surface, and especially high-pitched roofs.

The adjustable roofing jack 10 includes a frame 12 for engaging the surface of the roof 24. The frame 12 includes a first end 26 and a second end 28. The second end 28 has a downwardly depending substantially V-shaped configuration with first and second ends 30–32. The frame 12 is constructed from a rigid material such as steel. The preferred embodiment is fabricated from a steel plate of a selected width and thickness. The steel plate of this embodiment is bent to form a V-shaped portion proximate the second end 28 as described above. The steel plate may be bent by scoring at each desired bend, bending at each score, and welding the interior of each bend for strength. The frame 12 may also be bent by any other conventional manner.

Figure 2:
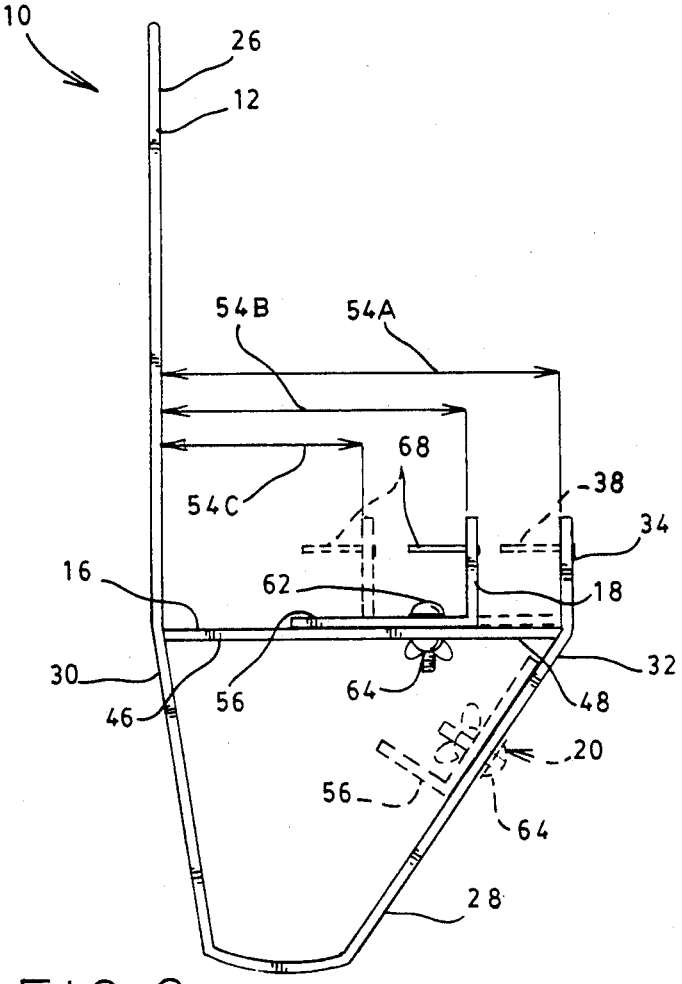
FIG. 2 illustrates a partial side elevation view of the adjustable roofing jack showing the adjustment means employed with alternate positions shown in phantom.
Figure 8:
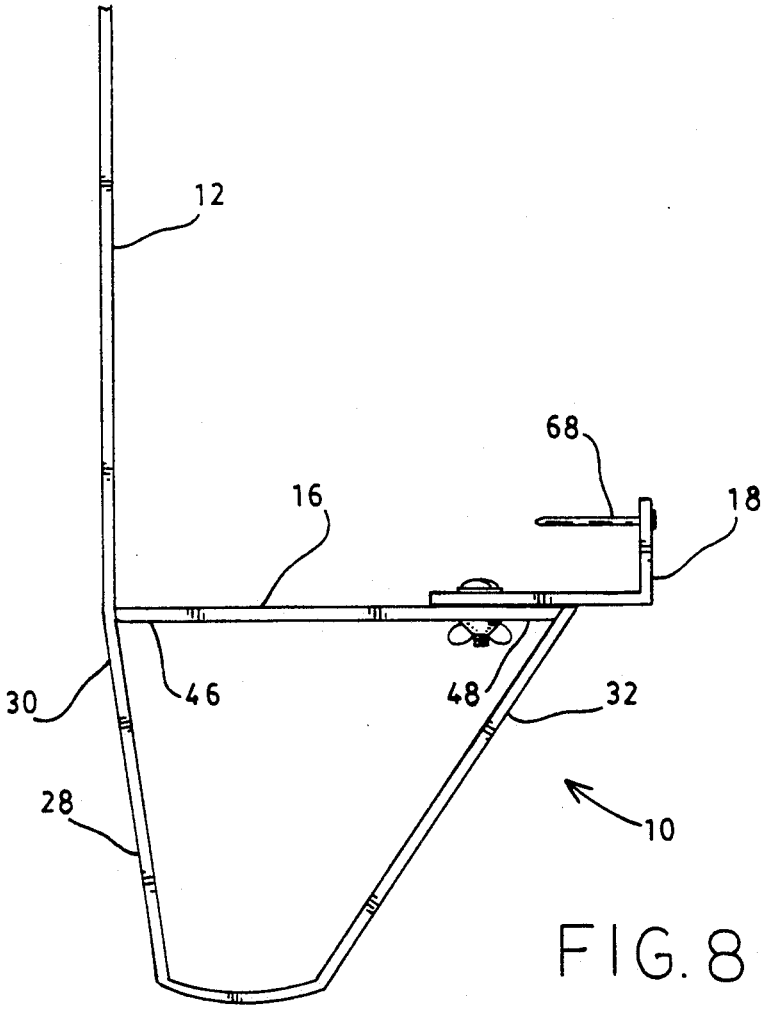
FIG. 8 illustrates a partial side elevation view of an alternate embodiment of the adjustable roofing jack of the present invention. means, the scaffold support means defining a slotted opening.

One embodiment of the frame 12, as shown in FIGS. 1 and 2, includes a portion 34 extending from the second end 28. As shown, this extended portion 34 is provided to engage one side of a scaffold board 22 when the adjustment means 18 is not deployed. The extended portion 34 defines the board width limit 54A without necessitating the alteration of the board. An opening 36 is defined by the extended portion 34 for the receipt of a nail, screw or other conventional fastener 38, the fastener 38 attaching to a scaffold board 22 and being used to prevent the scaffold board 22 from rotating axially. In another embodiment, as illustrated in FIG. 8, the second end 28 of the frame 12 terminates at the scaffold support means 16 such that the adjustment means 18 may extend beyond the frame 12.

Figure 4:
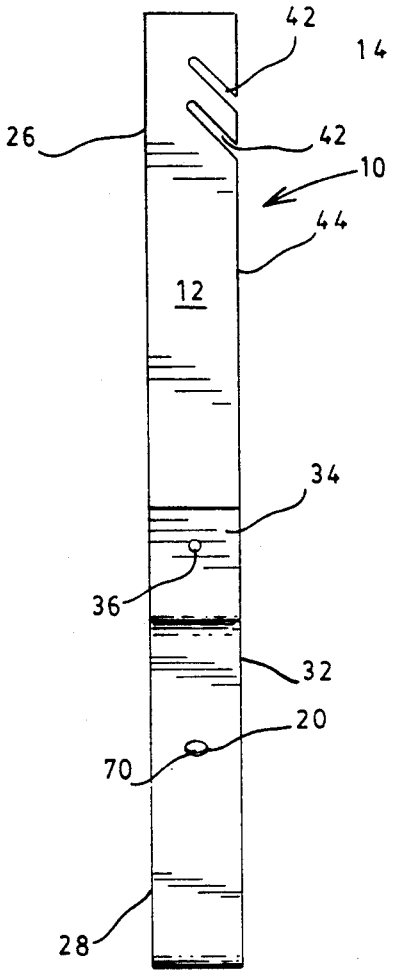
FIG. 4 is a front elevation view of the adjustable roofing jack.
Figure 5:
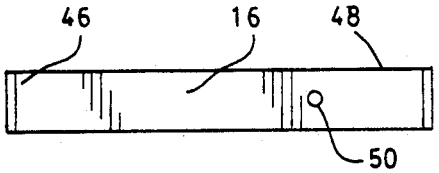
FIG. 5 illustrates a top elevation view of the adjustable roofing jack showing the scaffold support means.

A securement means 14, shown in FIGS. 1 and 4, is carried by the frame 12 for receiving at least one selected fastener 40 to secure the adjustable roofing jack 10 to the roof 24. In the preferred embodiment, at least two slots 42 are defined by the frame 12 proximate the first end 26. The slots 42 of this embodiment depend from one side 44 and extend at an acute angle toward the frame first end 26. The slots 42 allow for the removal of the roofing jack 10 while leaving the fasteners 40 in place for subsequent use at the same position. Alternatively, the securement means 14 may include at least one opening (not shown) defined by the frame 12 proximate the first end 26, each opening being dimensioned to receive a selected fastener 40 such as a nail or a screw, the roofing jack 10 being removable only by the removal of the fasteners 40.

A scaffold support means 16 is attached to the frame 12 proximate the first and second ends 30–32 of the V-shaped portion 28, as best shown in FIG. 2, for supporting a scaffold board 22 of a selected width. The scaffold support means 16 is fabricated from a rigid material such as steel. The preferred embodiment is fabricated from a steel plate of a selected width and thickness equal to that of the frame 12. The scaffold support means 16 includes first and second ends 46–48, the first and second ends 46–48 being connected to the first and second ends 30–32 of the frame V-portion 28, respectively. The first ends 30–46 of the scaffold support means 16 and V-portion 28 define a substantial right angle such that when the roofing jack 10 is engaged, the scaffold support means 16 is substantially normal to the roof surface 24. The scaffold support means 16 and frame V-portion 28 thus define a substantial right triangle configuration.

An adjustment means 18 is provided for altering the effective width of the scaffold support means 16, the effective width being defined by the distance between the first and second ends 30–32 of the frame V-portion 28, as shown by arrows 54A-B-C in FIG. 2. The adjustment means 18 includes an angled member 56 with first and second legs 58–60 and a fastening means 64 for securing the angled member 56 to the scaffold support means 16. The fastening means 64 includes at least one opening 62 defined by the angled member 56 proximate the first leg 58, at least one cooperating opening 50 defined by the scaffold support means 16, and a conventional fastener 64 such as a bolt and cooperating lock washer and wing nut. In the preferred embodiment, cooperating openings 62–50 are defined by each of the angled member 56 and the scaffold support means 16 such as to receive the fastener 64 and fix the position of the angled member 56 in relation to the scaffold support means 16. In the preferred embodiment shown in FIG.

Figure 3:
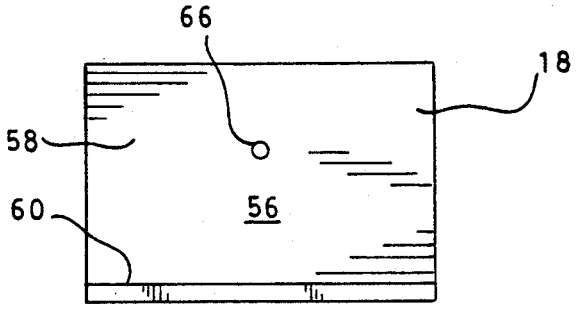
FIG. 3 is a left side elevation view of the adjustment means angled member.
Figure 6:
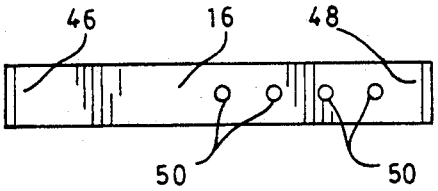
FIG. 6 illustrates a top elevation view of the adjustable roofing jack showing an alternate embodiment of the scaffold support means, the scaffold support means defining a plurality of spaced openings.
Figure 7:
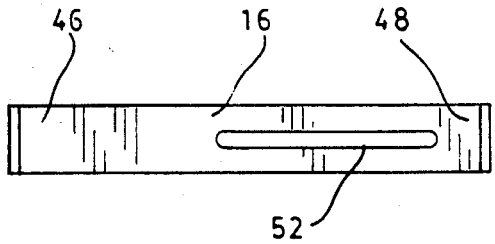
FIG. 7 illustrates a top elevation view of the adjustable roofing jack showing an alternate embodiment of the scaffold support

2. the angled member 56 may be fixed in two positions—as shown in phantom to secure a selected width scaffold board 22 denoted by arrow 54C, and as shown to secure a larger selected size scaffold board 22 denoted by arrow 54B. With the adjustment means 18 removed, the roofing jack 10 with the frame extended section 34 included is dimensioned to secure an even larger selected size scaffold board 22 denoted by arrow 54A. In another embodiment, as shown in FIG. 6, the scaffold support means 16 defines a plurality of openings 50 disposed laterally from one another, the openings 50 dimensioned to cooperate with the opening 62 defined by the angled member 56 such that the angled member 56 may be fixed in increments along the scaffold support means 16. In another embodiment, as shown in FIG. 7, the opening 52 defined by the scaffold support means 16 has a slotted configuration such that an infinite number of positions may be attained at which the angled member 56 may be fixed. In the same manner, the angled member 56 may define a plurality of openings 62 or a slotted opening (not shown). The second leg 60 of the angled member 56 defines an opening 66 (FIG. 3) dimensioned to receive a nail, screw or other conventional fastener 68, the fastener 68 attaching to a scaffold board 22 and being used to prevent the scaffold board 22 from rotating axially.

A storage means 20 for storing the adjustment means 18 when not deployed is carried by the frame 12. In the preferred embodiment shown in FIG. 2, the storage means 20 includes an opening 70 defined by the V-portion 28 of the frame 12 proximate the second end 32. The opening 70 is dimensioned to cooperate with the angled member opening 62 to receive the adjustment means fastener 64. In this embodiment, the angled member 56 is disposed within the right triangle formed by the frame V-portion 28 and the scaffold support means 16.

From the foregoing description, it will be recognized by those skilled in the art that an adjustable roofing jack offering advantages over the prior art has been provided. Specifically, the adjustable roofing jack provides for the securement of a scaffold of a selected size for roofers to prevent falls and other dangers associated with working on an inclined surface, and especially high-pitched roofs.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

1. An adjustable roofing jack for supporting a scaffold with a selected width, said scaffold for supporting a roofer while working on an inclined roof, said adjustable roofing jack comprising:

a frame for attaching to said roof, said frame having first and second ends;

a securement means carried by said frame proximate said first end for receiving at least one fastener, said securement means preventing said adjustable roof jack from movement in relation to said roof, said fastener engaging said roof;

a scaffold support means connected to said frame for engaging said scaffold;

an adjustment means carried by said scaffold support means for selectively adjusting the effective width of said scaffold support means to a width substantially equal to the width of said scaffold; and storage means carried by said frame for storing said adjustment means when not deployed.

2. The adjustable roofing jack of claim 1 wherein said frame is fabricated from a rigid material such as plate steel.

3. The adjustable roofing jack of claim 1 wherein said second end of said frame has a substantially V-shaped configuration with first and second ends.

4. The adjustable roofing jack of claim 1 wherein said securement means includes a plurality of slots opening on one side of said frame and extending at a selected angle toward said frame first end.

5. The adjustable roofing jack of claim 1 wherein said scaffold support means is fabricated from a rigid material such as plate steel.

6. The adjustable roofing jack of claim 1 wherein said scaffold support means is attached to said second end of said frame proximate each end of said V-shaped portion, said scaffold support means being attached by a method such as welding.

7. The adjustable roofing jack of claim 1 wherein said scaffold support means includes an extended section carried by said frame second end, said extended section for engaging said scaffold to prevent said scaffold from unselected displacement in a direction parallel to said scaffold support means, and said extended section defining at least one opening for receiving a fastener for preventing rotation of said scaffold.

8. The adjustable roofing jack of claim 1 wherein said adjustment means includes an angled member, a fastener receptacle carried by said angled member, a fastener receptacle carried by said scaffold support means, and a fastener, said angled member having a configuration defining a substantial right angle, said fastener receptacles being openings defined by said angled member and said scaffold support means, and said openings in said angled member and said scaffold support means cooperating to receive said fastener.

9. The adjustable roofing jack of claim 8 wherein at least one of said openings has a slotted configuration such that said adjustment means may be selectively secured in an infinite number of positions along said scaffold support means.

10. The adjustable roofing jack of claim 8 wherein said fastener receptacle defined by said scaffold support means includes a plurality of openings, said plurality of openings being defined by said scaffold support means for selectively positioning said adjustment means at increments along said scaffold support means.

11. The adjustable roofing jack of claim 6 wherein said scaffold support means is affixed on said frame in a position substantially perpendicular to said inclined roof.

12. An adjustable roofing jack for supporting a scaffold with a selected width, said scaffold for supporting a roofer while working on an inclined roof, said adjustable roofing jack comprising:

a frame for attaching to said roof, said frame being fabricated from plate steel and having first and second ends, said second end having a substantially V-shaped configuration with first and second ends;

a securement means carried by said frame proximate said first end for receiving at least one fastener, said securement means preventing said adjustable roof jack from movement in relation to said roof, and said securement means including a plurality of slots opening on one side of said frame and extending at a selected angle toward said frame first end, said fastener engaging said roof;

a scaffold support means connected to said frame for engaging said scaffold, said scaffold support means being fabricated from plate steel, and said scaffold support means being attached to said second end of said frame proximate each end of said V-shaped portion, said scaffold support means being attached by a method such as welding;

an adjustment means carried by said scaffold support means for selectively adjusting the effective width of said scaffold support means to a width substantially equal to the width of said scaffold, said adjustment means including an angled member, a fastener receptacle carried by said angled member, a fastener receptacle carried by said scaffold support means, and a fastener, said angled member having a configuration defining a substantial right angle, said fastener receptacles being openings defined by said angled member and said scaffold support means, and said openings in said angled member and said scaffold support means cooperating to receive said fastener; and a storage means for storing said adjustment means when not deployed.

13. The adjustable roofing jack of claim 12 wherein said scaffold support means includes an extended section carried by said frame second end, said extended section for engaging said scaffold to prevent said scaffold from unselected displacement in a direction parallel to said scaffold support means, and said extended section defining at least one opening for receiving a fastener for preventing rotation of said scaffold.

14. The adjustable roofing jack of claim 12 wherein at least one of said openings has a slotted configuration such that said adjustment means may be selectively secured in an infinite number of positions along said scaffold support means.

15. The adjustable roofing jack of claim 12 wherein said fastener receptacle defined by said scaffold support means includes a plurality of openings, said plurality of openings being defined by said scaffold support means for selectively positioning said adjustment means at increments along said scaffold support means.

16. The adjustable roofing jack of claim 12 wherein said scaffold support means is affixed on said frame in a position substantially perpendicular to said inclined roof.

17. An improved adjustable roofing jack for supporting a scaffold with a selected width, said scaffold for supporting a roofer while working on an inclined roof, said improved adjustable roofing jack being of the type including a frame means for attaching said roofing jack to an inclined roof, a securement means carried by said frame for securing said roofing jack to said roof, and a scaffold support means for engaging a scaffold, wherein the improvement comprises:

adjustment means carried by said scaffold support means for selectively adjusting the effective width of said scaffold support; and a storage means for storing said adjustment means when not deployed.

18. The improved adjustable roofing jack of claim 17 wherein said adjustment means includes an angled member, a fastener receptacle carried by said angled member, a fastener receptacle carried by said scaffold support means, and a fastener, said angled member having a configuration defining a substantial right angle, said fastener receptacles being openings defined by said angled member and said scaffold support means, and said openings in said angled member and said scaffold support means cooperating to receive said fastener.

19. The improved adjustable roofing jack of claim 18 wherein at least one of said openings has a slotted configuration such that said adjustment means may be selectively secured in an infinite number of positions along said scaffold support means.

20. The improved adjustable roofing jack of claim 18 wherein said fastener receptacle defined by said scaffold support means includes a plurality of openings, said plurality of openings being defined by said scaffold support means for selectively positioning said adjustment means at increments along said scaffold support means.

* * * * *